United States Patent [19]

Staffin et al.

[11] Patent Number: 4,613,713

[45] Date of Patent: Sep. 23, 1986

[54] METHOD AND APPARATUS FOR PYROLYSIS OF ATACTIC POLYPROPYLENE

[75] Inventors: H. Kenneth Staffin, New Brunswick; R. B. Roaper, Martinsville, both of N.J.

[73] Assignee: Procedyne Corp., New Brunswick, N.J.

[21] Appl. No.: 613,087

[22] Filed: May 22, 1984

Related U.S. Application Data

[62] Division of Ser. No. 443,235, Nov. 22, 1982.

[51] Int. Cl.[4] ..... C07C 4/04; C10G 9/16; C10B 43/10; C10B 51/00

[52] U.S. Cl. ..... 585/241; 208/48 R; 201/2; 201/25; 202/241

[58] Field of Search ..... 585/241; 208/48 R; 201/2, 25

[56] References Cited

U.S. PATENT DOCUMENTS

| | | | |
|---|---|---|---|
| 1,470,359 | 10/1923 | Greenstreet | 208/48 R |
| 2,729,428 | 1/1956 | Milmore | 208/132 |
| 2,884,373 | 4/1959 | Bailey | 208/132 |
| 3,641,190 | 2/1972 | Kivlen et al. | 208/48 R |
| 3,732,123 | 5/1973 | Stolfa et al. | 208/48 R |
| 3,956,414 | 5/1976 | Oshima | 585/241 |

FOREIGN PATENT DOCUMENTS

| | | | |
|---|---|---|---|
| 5141001 | 6/1976 | Japan | 585/241 |
| 0071789 | 5/1980 | Japan | 585/241 |

*Primary Examiner*—Andrew H. Metz
*Assistant Examiner*—O. Chaudhuri
*Attorney, Agent, or Firm*—Kane, Dalsimer, Kane, Sullivan and Kurucz

[57] ABSTRACT

This invention relates to an apparatus and a method for pyrolytic decomposition of polymeric materials into lower molecular weight products involving the heat treatment of raw polymeric material within reactive conduits submerged in a fluidized bed furnace operated at pyrolizing temperatures.

10 Claims, 1 Drawing Figure

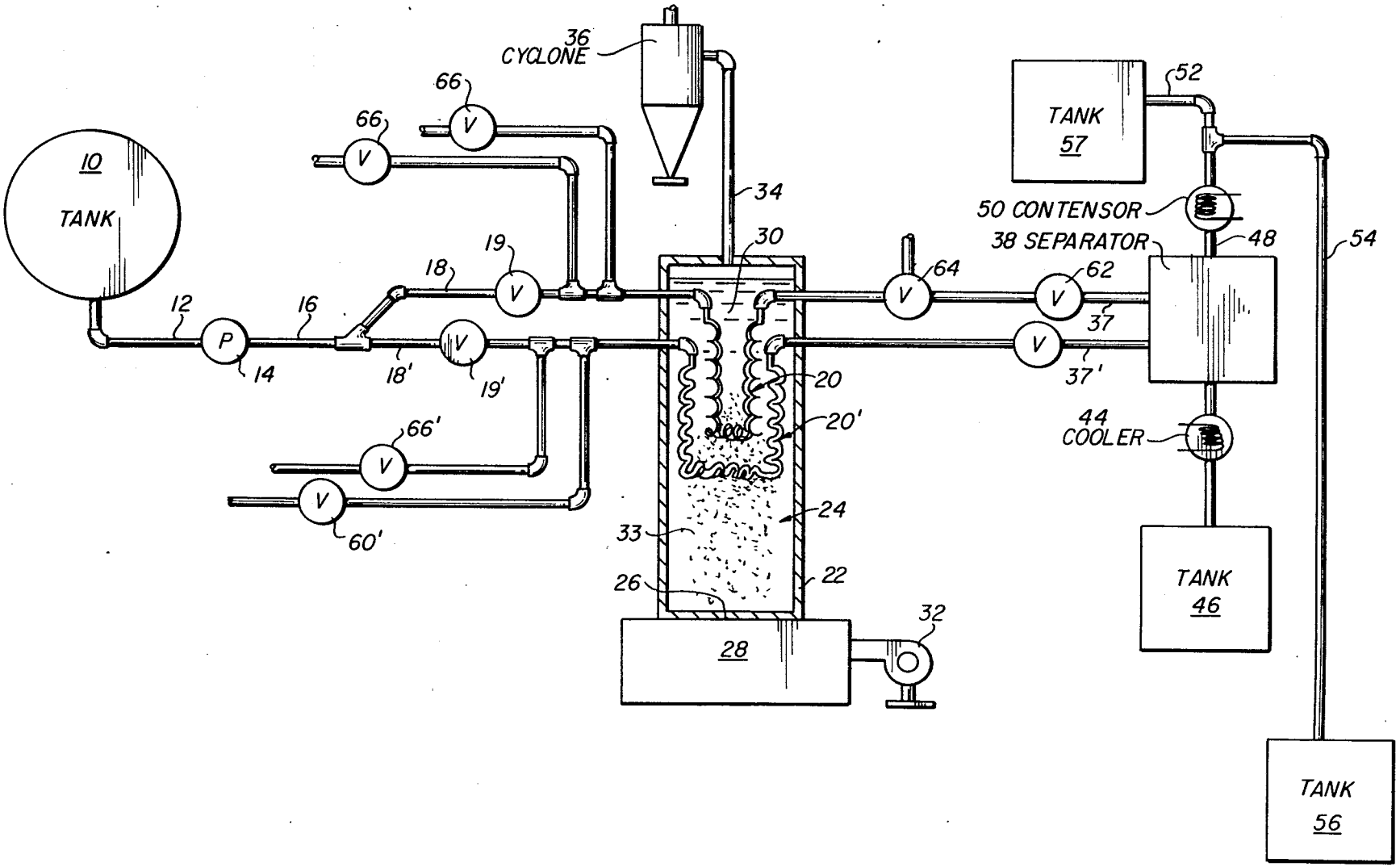
TANK 56
54
48
52
TANK 46
TANK 57
50 CONTENSOR
38 SEPARATOR
44 COOLER
62
37
37'
64
32
20
20'
24
22
34
30
28
33
26
36 CYCLONE
19
19'
66
18
18'
66'
60'
16
14
12
P
10 TANK

METHOD AND APPARATUS FOR PYROLYSIS OF ATACTIC POLYPROPYLENE

The Government has rights in this invention pursuant to contract No. DE-ACO1-79CS 40076 awarded by the U.S. Department of Energy.

This is a division of application Ser. No. 443,235, filed Nov. 22, 1982.

This invention relates to a process and an apparatus for the pyrolytic decomposition of polymeric materials and, in particular to the production of fuel oils and other useful products from atactic polypropylene.

BACKGROUND OF THE INVENTION

The ever increasing production of waste polymeric materials as by-products of industrial processes, and the like, has created a well recognized need for the disposal of such materials preferably providing some economical commercial use for them.

The heat content of most polymeric waste materials makes them potentially useful as fuels. However, many higher and intermediate molecular weight polymeric materials are semi-solids at room temperature, e.g. atactic polypropylene, which are difficult to feed and atomize and hence not suitable for direct burning in conventional systems. Various methods of thermally decomposing these polymeric waste materials into lower molecular weight fragments that are easy to handle and have economic value such as fuel oils and raw materials for industry are known in the art, for example see: U.S. Pat. Nos. 3,829,558, 3,832,151 or 4,151,216. A major problem with the known processes is accumulation of by-products, in particular, carbonaceous materials, on the heat transfer surfaces of the thermal reactors. Build-up of these materials on the heat transfer surfaces limits their efficiency and requires batch type operation or periodic shut downs for cleaning. The non-uniform heating characteristics of conventional furnaces contributes to this problem by creating hot spots on heat transfer surfaces along the path of waste materials to be thermally decomposed which promotes the accumulation of carbonaceous deposits. None of the techniques proposed in the prior art for dealing with this problem such as lower reaction temperatures, dispersal of accumulated carbon, and discharge of carbon rich fractions of the reactor material have sufficiently eliminated this problem to create a commercially viable continuous process.

SUMMARY OF THE INVENTION

In the present invention polymeric waste materials, such as atactic polypropylene, maybe melted in a heated tank to a viscosity at which it may be pumped at desired pressures preferably from 50–250 psig. The melted material is pumped via thermally insulated pipes to a reactor conduit, preferably, two or more independent reactor tubes and, more preferably, helically coiled tubes, of predetermined size wherein it is thermally decomposed by heat i.e. pyrolysis, to lower molecular weight fragments, relative to the molecular weight of the parent molecules on the polymeric material, in the absence of oxygen for a selected period of time. The reaction time is determined by the dimensions of the reactor tubes and rate of flow of raw material therethrough. The reactor tubes and materials therein are uniformly heated to precise temperatures by a fluidized bed. The pyrolyzed product discharges from the reactor tubes into a separation means, for example, a flash distillation device, whereby the product fragments are separated in groups substantially in accordance with their molecular weight. In the case of atactic polypropylene reacted at 800° F. for about 10 minutes, the principal products would be No. 6 and No. 2 fuel oils and some lighter gaseous fuels that are preferably used for fueling the heating means for the melt tank and fluidized bed.

It is an object of the present invention to provide a system for the pyrolytic decomposition of polymeric materials to lower molecular weight fragments that produces uniform products facilitated by a precise control of temperature uniformity and level within reactor tubes.

It is a further object of the present invention to provide an efficient and economical system for producing fuel oils from polymeric materials.

It is a further object of the present invention to provide a system suitable for a substantially continuous operation wherein one or more of the reactor tubes may be cleaned as hereinafter described without influencing the operation of other tubes.

With the above and other incidental objects in view as will more fully appear herein, the invention intended to be protected by Letters Patent consists of the features of construction, the parts and combinations thereof, and the mode of operation as hereafter described or illustrated in the accompanying drawings, or their equivalents.

BRIEF DESCRIPTION OF THE DRAWING

FIG. 1 is a schematic flow diagram of the main adaption of the present invention to a system for the thermal decomposition of actactic polypropylene constructed in accordance with the present invention. In this drawing certain fittings, valves, instruments, heaters, agitators, pumps and the like have been omitted for purposes of clarity and they may be provided in any suitable conventional manner where necessary or desirable.

DETAILED DESCRIPTION OF THE INVENTION

As shown in FIG. 1, the system comprises a heated melt tank 10 connected to pump 14 by conduit 12. Pump 14 discharges into conduit 16 which divides into separate feed lines 18 and 18' for each of the corresponding reactor tubes 20 and 20' and each feed lines is provided with a valve 19 and 19' respectively. The reactor tubes 20 and 20' are preferably helical coils disposed as hereinafter described in the fluidized bed furnace 22 which comprises an enclosure 24 having a distributor plate 26 at its lower end that divides the enclosure into lower plenum 28 and upper bed zone 30. The lower plenum 28 is provided with burner system 32 for heating air to be passed upwardly through the distributor plate 26 into bed zone 30. A solid particulate bed media is disposed in bed zone 30 so that it becomes suspended in the hot gas passing upwardly through the distributor plate 26 creating a fluidized mass 33 that transfers the heat to reactor tubes 20 and 20' engulfed therein. The fluidizing air discharges from the enclosure 24 through conduit 34 into separator 36 preferably a cyclone, which removes entrained fluidized solids from the exhaust gas and discharges the gas into the atmosphere. The reactor tubes 2 and 20' discharge product into a separator 38, for example a flash distillation device, via conduits 37 and 37'. A conduit 42 connects the lower portion of separator 38 with a cooler 44 which leads to a first storage tank 46 for higher molecular weight product. A conduit 48 connects the separator 38 to a condenser device 50 having a first outlet conduit 52 for low molecular weight gaseous products and a second outlet conduit 54 for intermediate molecular weight liquid products said outlets being connected to appropriate storage facilities, for example, second and third storage tanks 56 and 57 respectively.

In the preferred embodiments of the present invention 'atactic polypropylene', that is, a partially crystalline material which forms a solid or semi-solid at room temperatures which is composed of a mixture of waste by-products from the commercial preparation of polypropylene, is converted by thermal decomposition into No. 6 and No. 2 fuel oils and other useful materials. Typically, the waste atactic polypropylene from a commercial polypropylene plant is collected in melt tank 10 wherein it is heated usually to about 400° F. until it becomes liquid enough to be pumped at 50–250 psig to reactor tubes 20 and 20' wherein it is heated to sufficient temperatures to break carbon-carbon bonds in the waste material (approximately 800° F. for a sufficient time) to produce the desired products. These products are usually 90% wt. liquid and 10% gaseous fuels, at about 25° C., and are discharged from the reactor tubes into separator 38 wherin the liquid fractions are separated into a heavy (high viscosity) portion, and a mixture of light (low viscosity) portions and the remaining gases which are sent to a condensor where the light (low viscosity) portion is condensed and the remaining gases are discharged to a suitable receptacle. These gases are preferably used to fuel the heaters for the melt tank and fluidized bed.

Though the extremely precise and uniform heating by the fluidized bed substantially reduces the amounts of carbonaceous deposits formed in the reactor tubes after extended periods of operation these by-products collect on the interior surfaces of the reactor tubes causing clogging and reducing the heat transfer rate from the fluidized bed to materials in the tubes.

The reactor tubes 20 and 20' are separately supplied with polymer material, nitrogen and air so that they may be 'burnt out', i.e. cleaned, individually without interrupting the processing in the other reactor coil (s) thus providing a continuous process.

By way of example, the 'burn out' operation is effected in the described system by cutting off the flow of atactic polypropylene to the selected reactor tube 20 in the operating system by closing feed valve 19 and opening purge inlet valve 60 to admit an inert gas, preferably nitrogen, thus forcing any feed product and/or pyrolyis product in the tube 20 onward clearing that part of the system. Shortly thereafter, product discharge valve 62 is closed cutting off product/purge gas flow to the separator 38 and purge discharge valve 64 opened to permit the nitrogen purge gas to be exhausted into the atmosphere or into the plenum chamber of the fluid bed furnace for combustion of any pyrolysis products before discharge to atmosphere. Air inlet valve 66 is then opened permitting oxygen containing gas to enter the reactor tube 20 causing spontaneous combustion of any carbonaceous build-up remaining in the tube 20 after the nitrogen purge. Nitrogen inlet valve 60 may be closed at this point to accelerate the combustion by increasing the available oxygen. The heat of combustion would normally cause excessive temperatures damaging or destroying the reactor tube in conventional systems. In the present invention, temperature of the reactor tubes is controlled at safe levels by the fluidized bed which efficiently carries the excess heat away preventing damage from overheating caused by the heat of combustion of the carbonaceous deposits.

When all the carbonaceous material is burnt out of the tube 20 it is returned to service by closing the air inlet valve 66 and purging the reactor tube 20 with nitrogen until all oxygen is exhausted. Discharge valve 64 and nitrogen inlet valve 60 are then closed and feed valve 19 reopened permitting polymeric material to flow into the tube. Finally product discharge valve 62 is reopened restoring tube 20 to full operation.

As noted above, the other reactor tube 20' remains in operation unaffected by the burn out of tube 20. When reactor tube 20 is returned to full service 20' may be burnt out without affecting tube 20 by following the same procedure outlined above on the corresponding valves for that tube. It will be appreciated that systems having a plurality of reactor tube preferably two to six, are contemplated by the present invention and that more than one of these tubes may be 'burnt out' at one time by obvious modification of the method described above.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

What is claimed is:

1. A method for pyrolizing polymeric materials, which comprises: melting the polymeric material prior to passing it thru a reactor and conduit;

passing the polymeric material thru the reactor conduit disposed in a fluidized bed thereby exposing the polymeric material to pyrolizing temperatures causing it to decompose into lower molecular weight fragments whereby the fluidized bed heats the polymeric material to pyrolizing temperatures causing it to decompose cleaning carbonaceous deposits from the reactor conduit by exposing the deposits to oxygen at sufficient temperatures to cause combustion of said deposits and contacting surfaces of the reactor conduit with fluidized particles of the fluidized bed to conduct heat away from the surfaces at a rate sufficiently high to permit rapid combustion of the deposits without damage to the surface of the reactor conduit.

2. The method of claim 1 further comprising the step of separating the polymeric material fragments by sizes when they emerge from the reactor tube.

3. The method recited in claim 2 wherein a plurality of reactor conduits are provided and the cleaning step is carried out in at least one reactor conduit while polymeric material is pyrolytically decomposed in at least one other reactor conduit so that the apparatus continuously produces the lower molecular weight fragments.

4. The method recited in claim 3 further comprising: the step of purging the reactor conduits with an inert gas before exposing carbonaceous deposits therein to oxygen.

5. The method recited in claim 4 further comprising: the step of purging the reactor conduits with an inert gas after carbonaceous deposits have been combusted therein.

6. The method recited in claim 4 wherein the inert gas is nitrogen.

7. The method recited in claim 5 wherein the inert gas is nitrogen.

8. The method recited in claims 3, 4, 5, 6 or 7 wherein the oxygen is contained in air introduced to the reactor conduits.

9. The method of claim 1 wherein the step of melting the polymeric material further comprises passing polymeric material in a solid state into a preheat tank to melt the polymeric material.

10. A method for pyrolyzing polymeric materials comprising:

providing a source of waste polymeric material;

preheating the polymeric material to melt it;

pumping the melted polymeric material through feed conduit into a heated fluidized bed through at least both a first and second reactor conduit;

heating the melted polymeric material in the reactor conduits to decompose it whereby the fluidizing bed heats the polymeric material;

separating high molecular weight product from low molecular weight product;

cleaning carbonaceous deposits from the reactor conduit by closing a valve in the feed conduit to stop the flow of melted polymeric material to the reactor conduits, introducing a purging gas, downstream of the valve, so that it passes into the reactor conduit to flush out excess polymeric material, introducing oxygen containing gas into the reactor conduit downstream of the valve to cause spontaneous combustion of the carbonaceous residue in the heated portion of the conduit, the fluidized bed conducting a portion of the heat of combustion away from the surfaces of the reactor conduit to prevent damage thereto.

* * * * *